US011098641B2

(12) United States Patent
Carrell

(10) Patent No.: US 11,098,641 B2
(45) Date of Patent: Aug. 24, 2021

(54) ENGINE SYSTEM HAVING CONTAINMENT BLANKET AND METHOD OF IMPROVING ENGINE SAFETY

(71) Applicant: NEXTIER COMPLETION SOLUTIONS INC., Houston, TX (US)

(72) Inventor: Nathan Evan Carrell, Katy, TX (US)

(73) Assignee: NEXTIER COMPLETION SOLUTIONS INC., Houston, TX (US)

( * ) Notice: Subject to any disclaimer, the term of this patent is extended or adjusted under 35 U.S.C. 154(b) by 105 days.

(21) Appl. No.: 16/439,225

(22) Filed: Jun. 12, 2019

(65) Prior Publication Data

US 2019/0376449 A1 Dec. 12, 2019

Related U.S. Application Data

(60) Provisional application No. 62/683,977, filed on Jun. 12, 2018.

(51) Int. Cl.

| | |
|---|---|
| ***F02B 77/10*** | (2006.01) |
| ***F02B 77/08*** | (2006.01) |
| ***F02B 39/16*** | (2006.01) |
| ***F02B 77/11*** | (2006.01) |
| *F02B 77/04* | (2006.01) |
| *F02B 77/02* | (2006.01) |

(52) U.S. Cl.

CPC ..... *F02B 77/10* (2013.01); *F02B 39/16* (2013.01); *F02B 77/08* (2013.01); *F02B 77/11* (2013.01); *F02B 77/02* (2013.01); *F02B 77/04* (2013.01)

(58) Field of Classification Search

CPC ..... F02B 77/10; F02B 39/16
USPC ..... 123/198
See application file for complete search history.

(56) References Cited

U.S. PATENT DOCUMENTS

| | | | | |
|---|---|---|---|---|
| 4,369,744 A * | 1/1983 | Kubozuka | F02F 7/008 123/195 C |
| 5,614,280 A * | 3/1997 | Hanna | B60R 21/00 123/198 E |
| 2016/0319770 A1* | 11/2016 | Nivarthi | F02F 7/0007 |
| 2017/0022896 A1* | 1/2017 | Brown | F02B 77/10 |
| 2019/0284983 A1* | 9/2019 | Mullen | B32B 5/024 |

* cited by examiner

*Primary Examiner* — Joseph J Dallo
*Assistant Examiner* — Yi-Kai Wang
(74) *Attorney, Agent, or Firm* — Avant Law Group, LLC

(57) ABSTRACT

An engine system includes an engine having a housing and moving parts for converting energy into mechanical motion; and a first containment blanket having a sheet member and a fastening system. The sheet member extends below a bottom of the engine housing. The fastening system holds the sheet member to the engine such that the first containment blanket laterally shrouds the engine housing to contain debris projected from the engine housing.

20 Claims, 4 Drawing Sheets

ENGINE SYSTEM HAVING CONTAINMENT BLANKET AND METHOD OF IMPROVING ENGINE SAFETY

CROSS-REFERENCE TO RELATED APPLICATIONS

This application claims priority to U.S. Provisional Patent Application No. 62/683,977, filed Jun. 12, 2018, the disclosure of which is incorporated by reference herein in its entirety.

BACKGROUND

Hydraulic fracturing operations involve very high pressures and flow rates. Current fleets used in hydraulic fracturing ("fracking") operations consist of multiples of high pressure pump systems (or "units") arranged and working together. The individual high-pressure pump systems are interconnected by low-pressure and high-pressure conduits. The low-pressure conduits are used to deliver the frack fluid to the pump systems, and the hydraulic fracturing pump systems energize the frack fluid to a high pressure. The high-pressure conduits aggregate the flow from the multiples of high-pressure pump systems and then deliver an aggregated flow to a well head and ultimately to a formation which is being hydraulically fractured.

Each high-pressure pump system typically includes an engine (diesel, electric, turbine, et cetera), transmission, power end, and fluid end. The engine powering each system generally ranges in power from 2000-2500 HHP, but variations are produced that meet and exceed 5000 HHP. Each power end typically includes a crankshaft, reduction gears, bearings, connecting rods, crossheads, and crosshead extension rods that collectively convert rotational energy to reciprocating energy. And each fluid end is typically a reciprocating high-pressure pump. The nature of the system is such that:

- there are very high forces present;
- there are many components under high loads and stress;
- each pump unit costs in the order of $1.2 M;
- each pump unit is located generally within 2-3 feet of another unit;
- when the operation is running, you are limited in ability to inspect and check systems;
- if a major component failure occurs, it is generally under maximum operating conditions;
- there are significant volumes of oils and fuels present in the individual units, and in aggregate with multiples of units positioned together;
- there are many exhaust and ignition points present; and
- engine life can be variable due to the loads they work under, various manufacturing defects, and operating practices.

Unit designs and configurations are fundamentally the same although there are multiple hydraulic fracturing pump system manufacturers, multiple component manufacturers, and multiple service companies operating, repairing, and maintaining them. Conditions of the systems vary widely in age, type, and state. Incidents have occurred where major engine failures resulted in internal components, such as rods and crank shafts, being ejected under high forces. And incidents have occurred where major engine failures resulted in flammable fluid, such as oils and fuel, being sprayed randomly from one pump system and onto other units—resulting in fires because of hot surfaces (e.g., exhaust manifolds) being present. People working in the area have been killed when these various failure incidents occurred, and millions of dollars of equipment have been lost.

SUMMARY

The following presents a simplified summary of the invention in order to provide a basic understand of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

According to one embodiment, an engine system includes an engine having a housing and moving parts for converting energy into mechanical motion; and a first containment blanket having a sheet member and a fastening system. The sheet member extends below a bottom of the engine housing. The fastening system holds the sheet member to the engine such that the first containment blanket laterally shrouds the engine housing to contain debris projected from the engine housing.

According to another embodiment, a method of improving safety of an engine having an engine housing and moving parts for converting energy into mechanical motion is described. The method includes (1) providing a first containment blanket having a fastening system and a sheet member with upper and lower ends; (2) laterally shrouding the engine housing with the sheet member of the first containment blanket such that the lower end of the sheet member of the first containment blanket extends below a bottom of the engine housing; and (3) using the fastening system of the first containment blanket to hold the sheet member of the first containment blanket in place such that the first containment blanket laterally shrouds the engine housing with the lower end of the sheet member of the first containment blanket extending below the bottom of the engine housing. Debris projected from the engine housing is contained by the sheet member of the first containment blanket and directed downwardly relative to the engine housing.

According to still another embodiment, an engine system includes an engine having a housing and moving parts for converting energy into mechanical motion; a first containment blanket having a sheet member and a fastening system; and a second containment blanket having a sheet member and a fastening system. The sheet member of the first containment blanket extends below a bottom of the engine housing, and the fastening system holds the sheet member such that the first containment blanket laterally shrouds the engine housing at a first side of the engine housing for containing debris projected from the first side of the engine housing. The sheet member of the second containment blanket extends below the bottom of the engine housing, and the fastening system holding the sheet member such that the second containment blanket laterally shrouds the engine housing at second side of the engine housing for containing debris projected from the second side of the engine housing.

DETAILED DESCRIPTION

Figure 1:
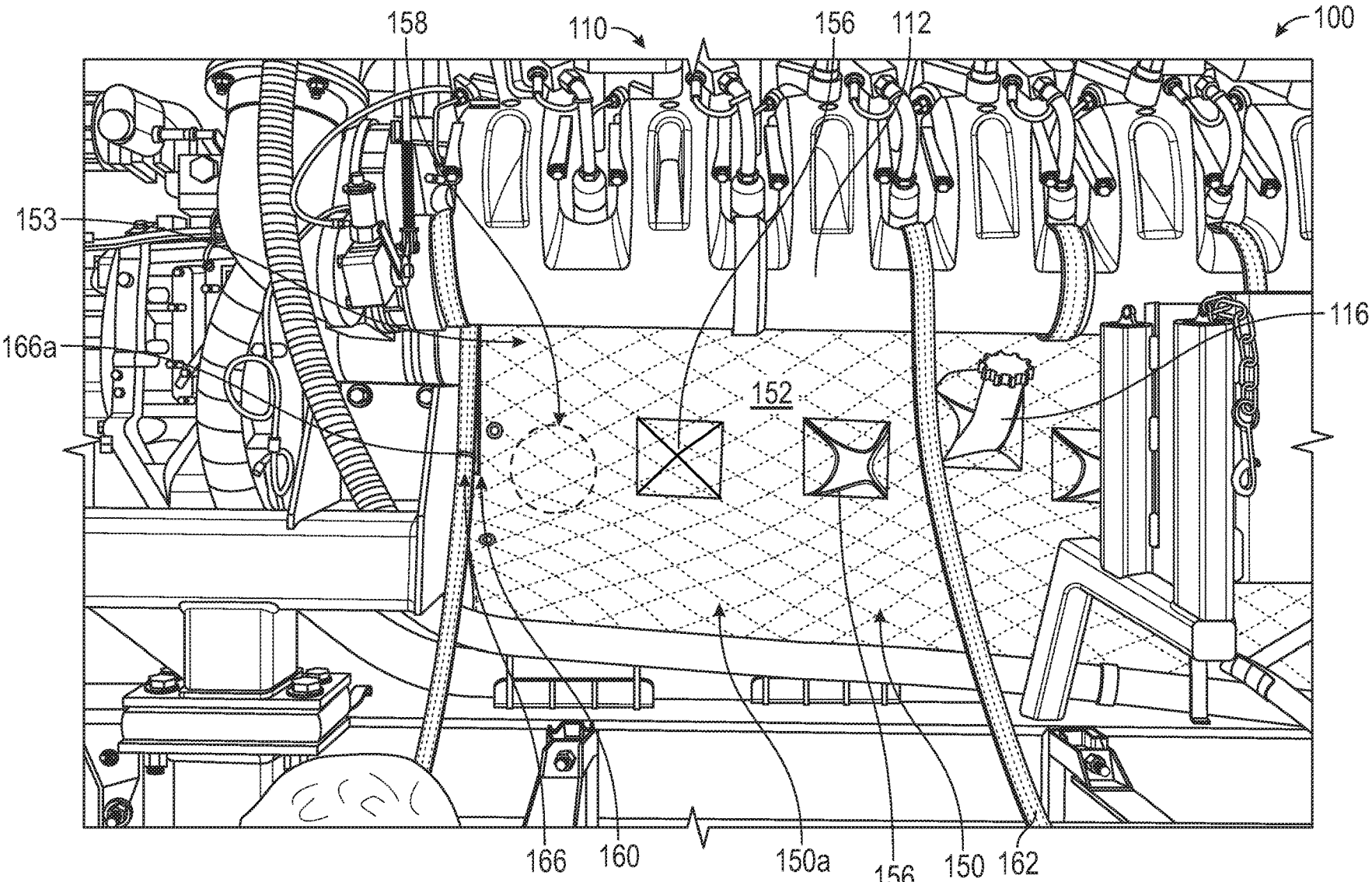
FIG. 1 is a side view showing an engine system according to an embodiment of the current invention, with environmental components.
Figure 2:
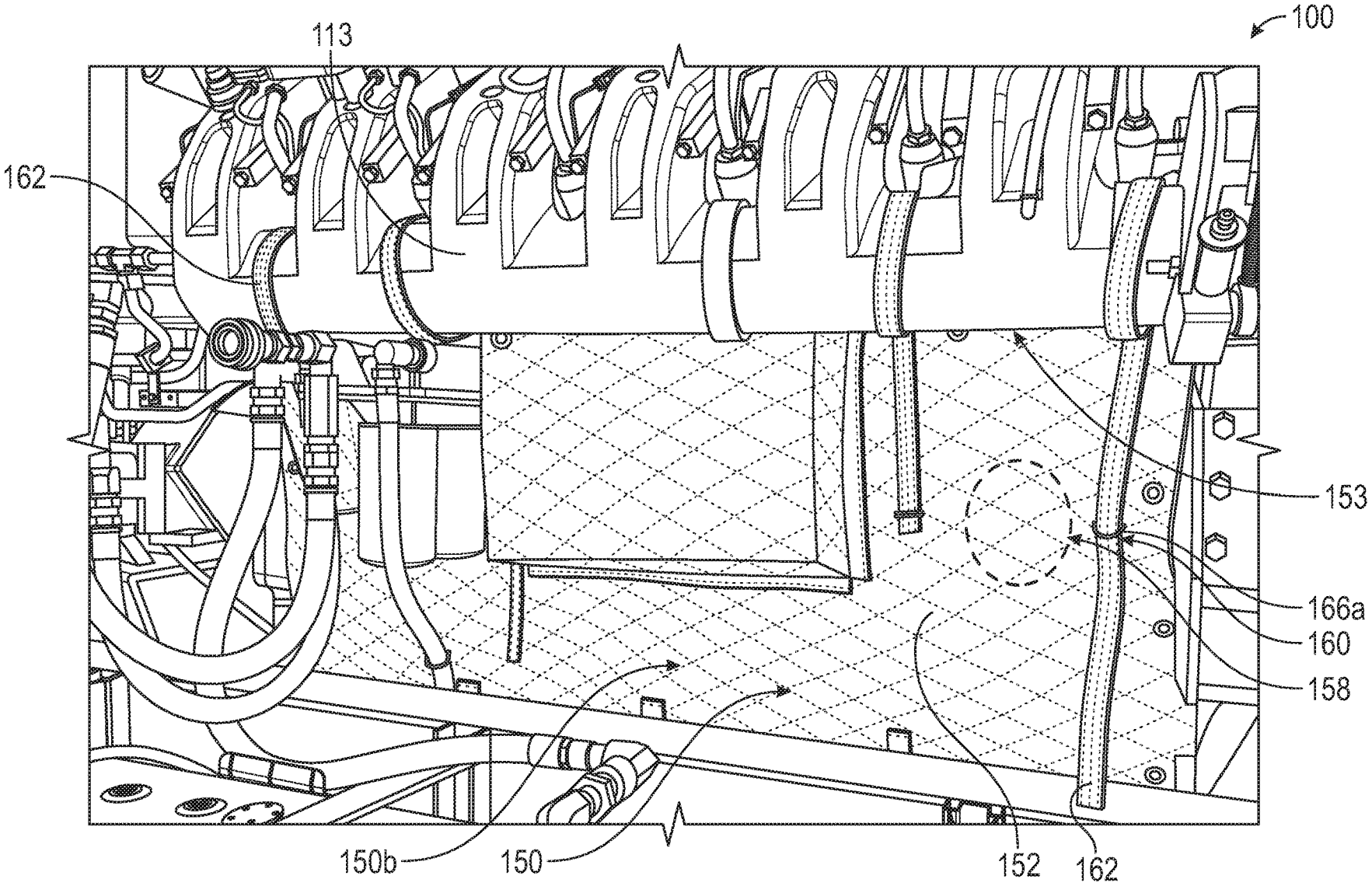
FIG. 2 is an opposite side view of the engine system of FIG. 1, with environmental components.

The failures experienced in high pressure pump units are fundamentally similar even though the units are configured using different sized engines, transmissions, power ends, radiators, et cetera. First, there is an internal failure of one or more major engine components under load, the resulting forces then cause the housing (also referred to as the block or casting) of the main engine structure to fracture, and finally various parts, including fluids (e.g., flammable liquids) and solids, may be ejected. In other words, there is a resultant loss of containment by the block, whereby fluids and/or solids may be allowed to escape with high force. This exposes nearby equipment to further damage, including mechanical damage, chemical damage, and temperature (or "burning") damage. People in the vicinity of the engine can also be hurt by flying debris or fluids.

FIGS. 1 through 4 show an engine system 100, which broadly includes an engine 110 and at least one containment blanket (or "shroud") 150. The engine 110 may be any engine (i.e., machine with moving parts to convert energy, such as heat from burning fuel, into mechanical motion), whether currently existing or later developed. It may be particularly desirable for the engine 110 to be a diesel engine or a gas turbine, and for the engine 110 to be appropriate for use in fracking operations; but other types of engines 110 may be used as well. The engine 110 shown in the figures is a diesel engine known in the art and broadly includes an intake manifold 112, an exhaust manifold 113, a housing (or "engine block") 114, a combustion chamber, an ignition system, valves, an exhaust system, a cooling system, a piston, a crankshaft, and a control system (or "engine control module" or "ECM"). Those skilled in the art will appreciate that the engine 110 generally includes a plurality of combustion chambers, valves, pistons, et cetera. The lubrication (or "cooling") system includes engine oil and at least one maintenance point (e.g., an oil dipstick) 116.

Focus is now directed to the containment blanket 150. The embodiment 100 has two containment blankets 150—a first containment blanket 150*a* and a second containment blanket 150*b*. Each containment blanket 150 is a puncture-, impact-, and temperature-resistant shroud having a sheet member 152 and a fastening system 160. Each sheet member 152 is sized and positioned to laterally shroud at least the engine block 114, though each sheet member 152 may or may not actually touch the engine block 114. Each sheet member 152 is flexible and has upper and lower ends 153 and 154, respectively. It may be particularly desirable for each upper end 153 to extend above a top of the engine block 114 and for each lower end 154 to extend below a bottom 114*a* of the engine block 114 when the respective fastening systems 160 hold the sheet members 152 in place.

In some embodiments, the sheet members 152 are sized for use with multiple types of engines 110. For example, the exact distance that the sheet members 152 extend below the bottom 114*a* of the engine block 114 may not be critical, allowing a respective sheet member 152 to accommodate engines 110 of various sizes and configurations. In other embodiments, the sheet members 152 are specifically configured for a specific engine size, type, and side. While the sheet members 152 may be constructed of various materials and include either one or multiple layers of material, it may be desirable for the sheet members 152 to be constructed of synthetic fibers having a high tensile strength. Kevlar® (poly paraphenylenediamine terephthalamide); other aramids, such as Nomex® (poly metaphenylenediamine isophthalamide) and/or Technora® (diaminodiphenylether paraphenylenediamine terephthaloyldichloride); and/or similar materials may be particularly well suited for the sheet members 152.

In the embodiment 100, each fastening system 160 includes straps 162 to position the respective sheet member 152 at the engine 110. More particularly, the straps 162 cooperate with anchor points 166 (e.g., D-rings 166*a*, loops, hooks, rivets, and hook and loop fasteners) or are permanently fastened (e.g., sewn or riveted) to the respective sheet member 152, and the straps 162 couple the upper ends 153 of the sheet members 152 to selected structure (with each sheet member 152 laterally shrouding the engine block 114). In the embodiment 100, the upper end 153 of the first containment blanket 150*a* is coupled to the intake manifold 112 and the upper end 153 of the second containment blanket 150*b* is coupled to the exhaust manifold 113. Lower ends of the straps 162 of the first containment blanket 150*a* may be coupled to lower ends of the straps 162 of the second containment blanket 150*b* or to the lower end 154 of the second containment blanket 150*b* (either directly or through anchor points). And lower ends of the straps 162 of the second containment blanket 150*b* may be coupled to lower ends of the straps 162 of the first containment blanket 150*a* or to the lower end 154 of the first containment blanket 150*a* (either directly or through anchor points). In other embodiments, the containment blanket(s) 150 may be attached to other selected structure, both above and below the engine block 114. Appropriate structure may include, for example, the engine 110 or components thereof or structural members of a frac pump.

Figure 3:
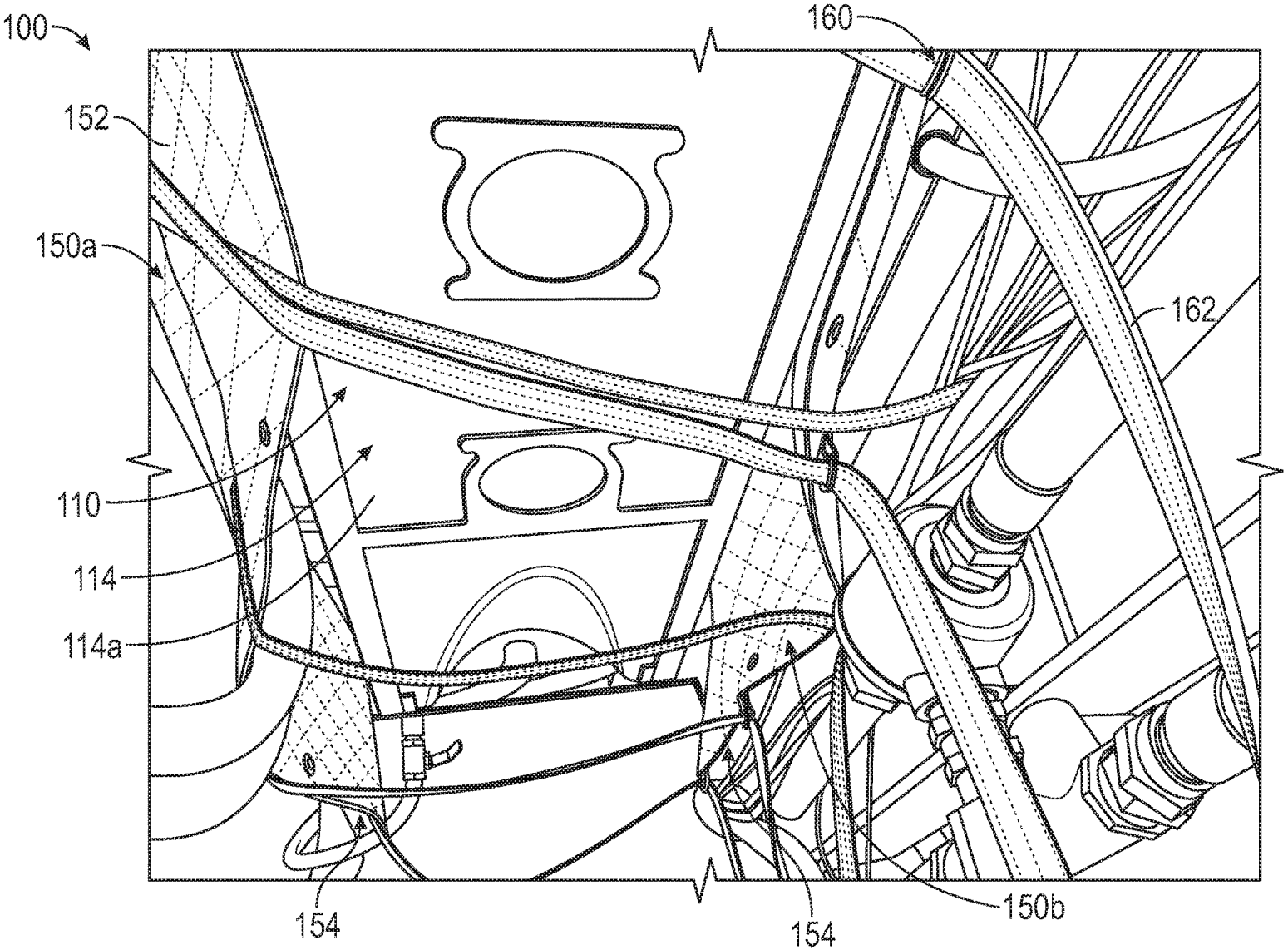
FIG. 3 is a bottom perspective view of the engine system of FIG. 1, with environmental components.
Figure 4:
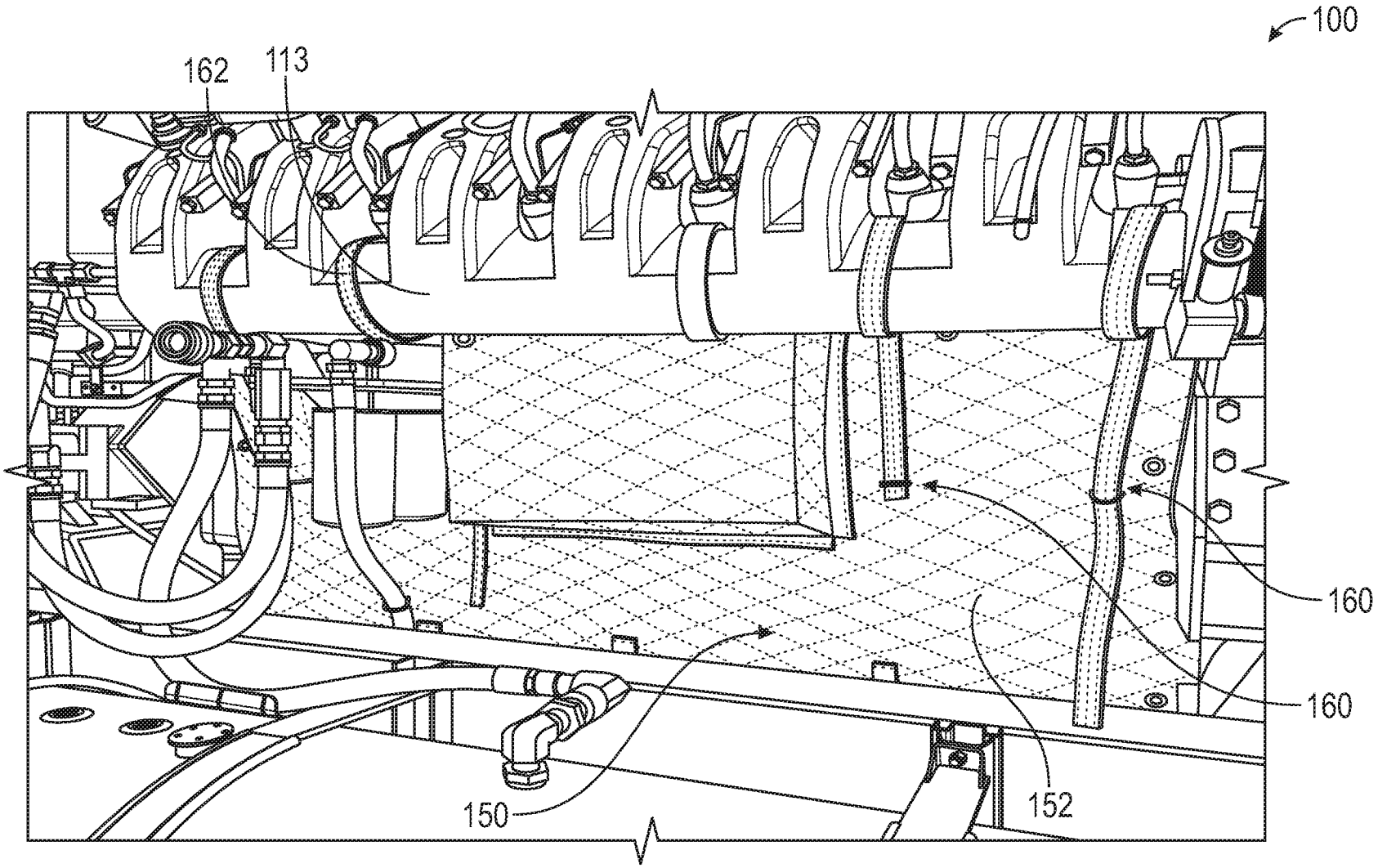
FIG. 4 is another side view of the engine system of FIG. 1, with environmental components.

FIG. 3 shows that the lower ends 154 of the sheet members 152 remain separated from one another when both containment blankets 150*a*, 150*b* are in place. The separation may be important in allowing air to reach the engine block 114 and also to allow any fluids to drain downwardly (and solid components to be directed downwardly) in the event of an engine failure. Yet in other embodiments, a single containment blanket 150 may extend from one side of the engine block 114, below the engine block 114, and back up the other side of the engine block 114; in such embodiments, drain holes in the sheet member 152 below the engine block 114 may be desirable. It may be preferable for each sheet member 152 and fastening system 160 to be constructed from materials that are weather resistant, chemical resistant, heat resistant, impact resistant, and puncture resistant. And it may be particularly desirable for the containment blankets 150 to be constructed of materials that can withstand temperatures of at least 1100 degrees Fahrenheit.

Flaps or other portals 156 in the respective sheet members 152 may align with engine maintenance points (e.g., the oil dipstick 116) or otherwise be strategically placed to provide access to engine components without having to remove the containment blankets 150. The portals 156 may be selectively opened to allow access to engine components; when not in use, the portals 156 may be secured in a closed position (e.g., via snaps, buttons, hook and loop fasteners, etc.) to prevent debris from exiting through the portal 156 in the event of an engine failure. The portals 156 may be provided in one or both of the first and second containment blankets 150*a*, 150*b*. Certain areas 158 of the shroud 150 may be more likely to experience failure; portals 156 may not be located in those areas. In some embodiments, the portals 156 may be omitted entirely. In any event, the blankets 150 can be easily removed when repairs are required so that all areas of the engine 110 may be exposed.

In use, the first and second containment blankets 150*a*, 150*b* are positioned around the engine 110 as described and shown—specifically, with the respective sheet members 152 laterally shrouding the engine 110 and with the lower ends 154 of the respective sheet members 152 extending downwardly past the bottom 114*a* of the engine block 114 and being separated from one another. And upon a catastrophic engine failure occurring, any items (whether solid or liquid) projected laterally from the engine 110 are contained and directed downwardly to ground by at least one of the sheet members 152. Very importantly, the projected items are not allowed to travel outwardly through the sheet members 152; this in particular my limit harm or damage to adjacent equipment and people.

Testing was conducted to determine if the blanket 150 caused the temperatures near the engine 110 to raise under use conditions. A heat gun was used to simulate the temperature of an engine 110 in use. Temperature data of the engine system 100 was collected and compared to temperate data from an engine in a system without the containment blankets 150*a*, 150*b*. At the start of the test, the temperature under the blanket was 167° F., and the ECM temperature registered at 93° F. The engine temperature of a system without a containment blanket 150 was 167° F., and the oil temperature was 164° F. After 30 minutes, the temperatures were again tested. The engine temperature was about 163° F., and the oil temperature was about 170° F. The temperature under the blanket was about 180° F., while the ECM temperature remained steady at about 95° F. One hour after the test began, the engine temperature was about 173° F., and the oil temperature was about 179° F. The temperature under the blanket rose to about 193° F., but the ECM temperature again remained steady at about 96° F. After 1.5 hours, the engine temperature remained steady at 175° F., with an oil temperature of 185° F. Under the blanket, the temperature was measured at about 200° F., with an ECM temperature of about 98° F. While temperatures are higher in the engine system 100, those higher temperatures are still within acceptable parameters. Therefore, the blanket 150 does not significantly increase the temperatures near the engine 110. However, it may be particularly important for the blanket(s) 150, through construction and/or positioning, to allow airflow such that the engine 110 will not overheat working in ambient conditions up to 120 degrees Fahrenheit in sustained (continuous) operation under load.

Many different arrangements of the various components depicted, as well as components not shown, are possible without departing from the spirit and scope of the disclosure. Embodiments of this disclosure have been described with the intent to be illustrative rather than restrictive. Antinormative embodiments will become apparent to those skilled in the art that do not depart from its scope. A skilled artisan may develop alternative means of implementing the aforementioned improvements without departing from the scope of the disclosure. It will be understood that certain features and subcombinations are of utility and may be employed without reference to other features and subcombinations, and are contemplated within the scope of this disclosure. Not all steps listed in the various figures need to be carried out in the specific order described. The description should not be limited to the specific described embodiments.

What is claimed is:

1. An engine system, comprising:

an engine having a housing and moving parts for converting energy into mechanical motion; and a first containment blanket having a sheet member and a fastening system, the sheet member extending beyond a bottom of the engine housing, the fastening system holding the sheet member such that the first containment blanket laterally shrouds the engine housing for containing debris projected from the engine housing, wherein the bottom of the engine is uncovered by the sheet member of the first containment blanket.

2. The engine system of claim 1, wherein the sheet member has a lower end extending beyond the bottom of the engine housing.

3. The engine system of claim 2, further comprising:

a second containment blanket having a sheet member and a fastening system, the sheet member of the second containment blanket having a lower end extending beyond the bottom of the engine housing, the fastening system of the second containment blanket holding the sheet member of the second containment such that the second containment blanket laterally shrouds the engine housing for containing and directing downwardly debris projected from the ending housing;

wherein the lower end of the sheet member of the second containment blanket is disconnected from the lower end of the sheet member of the first containment blanket.

4. The engine system of claim 3, wherein the engine has an intake manifold and an exhaust manifold, and wherein the fastening system of the first containment blanket is coupled to the intake manifold and the fastening system of the second containment blanket is coupled to the exhaust manifold.

5. The engine system of claim 1, wherein the engine has an intake manifold and the fastening system is coupled to the intake manifold.

6. The engine system of claim 1, wherein the engine has an exhaust manifold and the fastening system is coupled to the exhaust manifold.

7. The engine system of claim 1, wherein the first containment blanket further comprises a portal formed into the sheet member, the portal defining an access point to the engine through the sheet member.

8. The engine system of claim 7, wherein the portal is selectively openable, and wherein, when not opened, the portal is secured in a closed position.

9. The engine system of claim 7, wherein the engine comprises a maintenance point, and wherein the access point to the engine corresponds to the maintenance point of the engine.

10. The engine system of claim 1, wherein the sheet member withstands temperatures of at least 1100 degrees Fahrenheit.

11. The engine system of claim 1, wherein the sheet member comprises synthetic high tensile strength fibers.

12. The engine system of claim 1, wherein the engine is appropriate for use in hydraulic fracturing operations.

13. A method of improving safety of an engine having an engine housing and moving parts for converting energy into mechanical motion, the method comprising:

providing a first containment blanket having a fastening system and a sheet member with upper and lower ends;

laterally shrouding the engine housing with the sheet member of the first containment blanket such that the lower end of the sheet member of the first containment blanket extends beyond a bottom of the engine housing and does not cover the bottom of the engine housing; and using the fastening system of the first containment blanket to hold the sheet member of the first containment blanket in place such that the first containment blanket laterally shrouds the engine housing with the lower end of the sheet member of the first containment blanket extending beyond the bottom of the engine housing, whereby debris projected from the engine housing is contained by the sheet member of the first containment blanket and directed downwardly relative to the engine housing.

14. The method of claim 13, further comprising:

providing a second containment blanket having a fastening system and a sheet member with upper and lower ends;

laterally shrouding the engine housing with the sheet member of the second containment blanket such that the lower end of the sheet member of the second containment blanket extends beyond the bottom of the engine housing, the engine housing separating the sheet member of the first containment blanket from the sheet member of the second containment blanket; and using the fastening system of the second containment blanket to hold the sheet member of the second containment blanket in place such that the second containment blanket laterally shrouds the engine housing with the lower end of the sheet member of the second containment blanket extending beyond the bottom of the engine housing, whereby debris projected from the engine housing is contained by the sheet member of the second containment blanket and directed downwardly relative to the engine housing.

15. The method of claim 14, wherein each fastening system comprises a strap having an upper end and a lower end, and an anchor point, for securing the respective containment blanket to the engine.

16. The method of claim 15, further comprising:

engaging a lower end of the strap of the first containment blanket with the anchor point of the strap of the second containment blanket;

engaging a lower end of the strap of the second containment blanket with the anchor point of the strap of the first containment blanket.

17. The method of claim 14, wherein the sheet member of each containment blanket is constructed of aramid fibers.

18. An engine system, comprising:

an engine having a housing and moving parts for converting energy into mechanical motion;

a first containment blanket having a sheet member and a fastening system, the sheet member extending beyond a bottom of the engine housing, the fastening system holding the sheet member such that the first containment blanket laterally shrouds the engine housing at a first side of the engine housing for containing debris projected from the first side of the engine housing;

a second containment blanket having a sheet member and a fastening system, the sheet member extending beyond the bottom of the engine housing, the fastening system holding the sheet member such that the second containment blanket laterally shrouds the engine housing at second side of the engine housing for containing debris projected from the second side of the engine housing;

wherein the bottom of the engine housing is not covered by the first containment blanket or the second containment blanket.

19. The engine system of claim 18, wherein at least one of the first containment blanket and the second containment blanket comprises a portal formed into the sheet member thereof, the portal defining an access point to the engine through the sheet member; and wherein the portal is selectively openable, the portal being secured in a closed position when not opened.

20. The engine system of claim 18, wherein:

each fastening system comprises a strap having an upper end and a lower end, and an anchor point, for securing the respective containment blanket to the engine;

a lower end of the strap of the first containment blanket engages with the anchor point of the strap of the second containment blanket; and a lower end of the strap of the second containment blanket engages with the anchor point of the strap of the first containment blanket.

* * * * *